United States Patent [19]

Nakagawa

[11] 4,416,060

[45] Nov. 22, 1983

[54] SLIDE FASTENER FINISHING MACHINE

[75] Inventor: Toshiaki Nakagawa, Kurobe, Japan

[73] Assignee: Yoshida Kogyo K. K., Tokyo, Japan

[21] Appl. No.: 265,784

[22] Filed: May 21, 1981

[30] Foreign Application Priority Data

Jun. 4, 1980 [JP] Japan ..... 55-75063

[51] Int. Cl.[3] ..... A41H 37/06; B21D 53/50

[52] U.S. Cl. ..... 29/767; 29/766

[58] Field of Search ..... 29/408, 409, 766, 767, 29/768

[56] References Cited

U.S. PATENT DOCUMENTS

| | | | |
|---|---|---|---|
| 3,789,487 | 2/1974 | Kawakami | 29/767 |
| 3,792,521 | 2/1974 | Kawakami | 29/768 |
| 3,973,312 | 8/1976 | Douri et al. | 29/768 |
| 4,137,621 | 2/1979 | Scagnelli | 29/408 |

FOREIGN PATENT DOCUMENTS

| | | | |
|---|---|---|---|
| 809333 | 2/1959 | United Kingdom . | |
| 1024708 | 4/1966 | United Kingdom . | |
| 2042062 | 9/1980 | United Kingdom | 29/766 |

*Primary Examiner*—Mark Rosenbaum
*Assistant Examiner*—Steven Nichols
*Attorney, Agent, or Firm*—Hill, Van Santen, Steadman & Simpson

[57] ABSTRACT

A slide fastener finishing machine is disclosed. The machine is comprised of an upper frame, a bottom stop fastening head mounted on said upper frame for vertical movement and having a punch, a lower frame, a slider holding jig fixedly secured to said lower frame and offset toward the side facing the operator from the position right below the punch, a die holder mounted on said lower frame between said position right below the punch and said slider holding jig. Said die holder includes a die on the top thereof and is movable between a first position in which said die is aligned with said punch and second position in which the die is offset from the punch. A pusher plate means is secured to and extends from said die holder to be pushed by an operator to position said die holder right below said punch.

5 Claims, 6 Drawing Figures

SLIDE FASTENER FINISHING MACHINE

BACKGROUND OF THE INVENTION

This invention relates to a slide fastener finishing machine which is adapted to finish a slide fastener by manually assembling a slider and a bottom stop to slide fastener chains sewn on clothing—for example, trousers' fly—or slide fastener chains not secured to any support member.

Slide fastener finishing machines of the above-mentioned type are usually employed by makers of clothing such as trousers and are known from British Pat. No. 1,024,708, Japanese Laid-Open Patent Application No. 12,245/1976 and Japanese Patent Publication No. 7,423/1976. The principal components of the such type slide fastener finishing machine are a punch and a cooperating die adapted to fasten a bottom stop to the fastener chains in combination and a slider holding jig. The die and slider holding jig are adapted to reciprocally move between a position in which the die and slider holding jig are positioned right below the punch and a position in which the die and slider holding jig are offset from the punch.

Particularly, in the slide fastener finishing machine disclosed in British Pat. No. 1,024,708, an arm is rockably mounted on the machine frame, a die is mounted at the free end of the arm and a slider holding jig is mounted on the arm for vertical movement. In performing a slide fastener finishing operation with such a finishing machine, the arm is tilted so as to position the upper end of the slider holding jig above the upper end of the arm, and the operator uses both hands to manually thread the fastener chains through the slider held on the slider holding jig from the side of the punch. Then the operator releases his grip on the fastener chains and, while gripping the leading ends of the fastener chains with one hand, moves the jig down with the other hand to position on the die the part of the fastener chains where a bottom stop is to be fastened. Then while holding the chains on the die with one hand the operator uses his other hand to raise the arm for fastening the bottom stop to the fastener chains. Thus, in using the slide fastener finishing machine of the British Patent, it is necessary for the operator to change his or her grip on the fastener chains a number of times.

In the slide fastener finishing machine as disclosed in Japanese Laid-Open Patent Application No. 12,245/1976, clampers having a die holder and a jig, respectively, have different pivot points. As in the case of the slider fastener finishing machine of the above-mentioned British Patent, in the slide fastener finishing machine of the Japanese patent application, the operator must change his or her grip on the fastener chains a number of times. Furthermore, in the slide fastener finishing machine as disclosed in Japanese Patent Publication No. 7,423/1976, a die and a jig are mounted on a rockable die block, fastener chains are threaded through a slider held on the jig towards a punch to position the leading ends of the fastener chains onto the die. However, in the slide fastener finishing machine of the last-mentioned Japanese patent application, it is required to secure the leading ends of the fastener chains to the die by the operator's one hand and then move the die block to an upright position right below the punch. Thus, in any one of the above-mentioned known slide fastener finishing machines, it is necessary for the operator to change his or her grip on the fastener chains during the finish operation and since the fastener chains are gripped with just one hand, the grip is not strong and the fastener chains tend to slip. Furthermore, changing the grip on the fastener chains is time consuming and inefficient.

SUMMARY OF THE INVENTION

The purpose of the present invention is to provide a slide fastener finishing machine in which in use the operator, by using the fingertips of both hands, threads the leading ends of fastener chains to be finished through a slider until the place where the bottom stop is to be fastened is right below the punch. The operator does not have to change his or her grip while threading the fastener through the slider, so the slide fastener finishing operation can be performed safely, positively and rapidly.

Although the slide fastener finishing machine of the invention essentially comprises a punch, a die and a slider holding jig as in the case of any of the other slide fastener finishing machines of this type, according to the present invention, the slider holding jig is not rockable, but is fixedly mounted on the machine frame in a position remote from the punch. The die is mounted in a die holder which is adapted to rock or move linearly between a position right below the punch and a position offset from the punch. Pusher plates are secured to and project from the die holder to extend the threading process of the fastener chains through the slider whereby the die can be moved to a position right below the punch during the feed of the fastener chains.

The above and other objects and attendant advantages of the present invention will be readily apparent to those skilled in the art from a reading of the following detailed description in conjunction with the accompanying drawings which show preferred embodiments of the present invention for illustration purpose only, but not for limiting the scope of the same in any way.

DETAILED DESCRIPTION OF THE PREFERRED EMBODIMENTS

Figure 1:
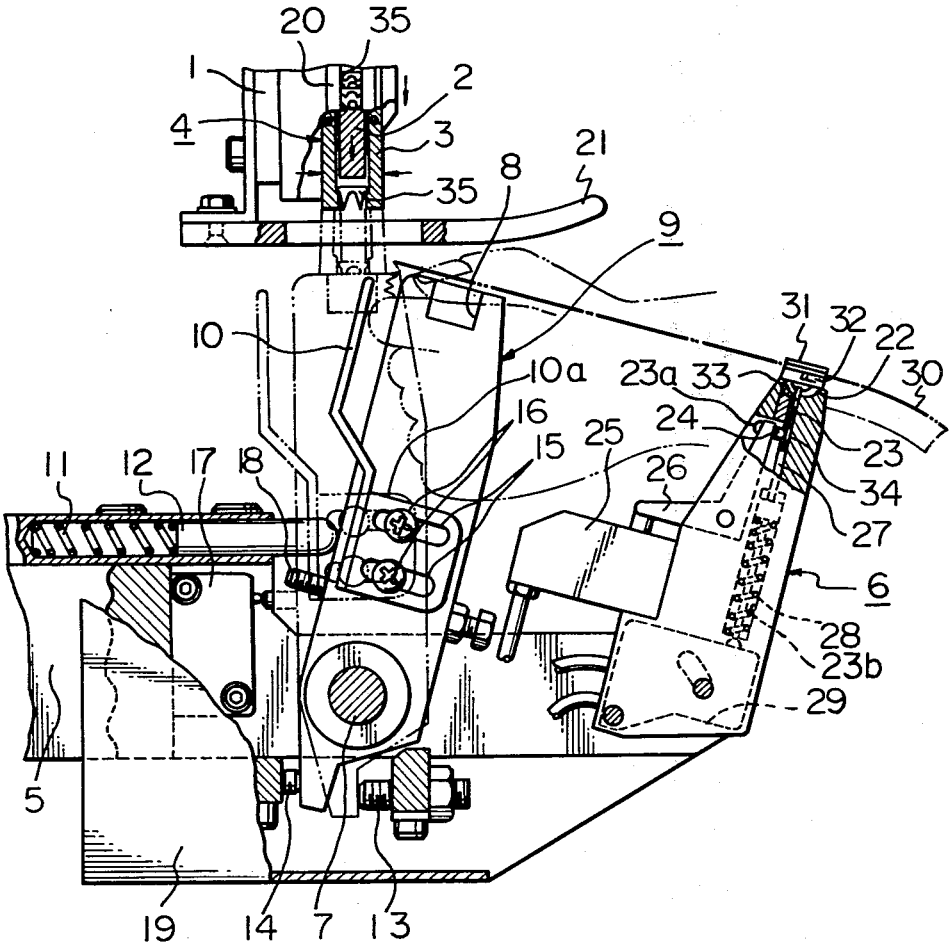
FIG. 1 is a fragmentary side elevational view in partial section of one preferred embodiment of the slide fastener finishing machine constructed in accordance with the present invention.

The present invention will be now described referring to the accompanying drawings and more particularly, to FIG. 1 thereof in which one embodiment of the slide fastener finishing machine of the invention is generally shown. As shown in FIG. 1, a vertically extending upper frame 1 has a bottom stop fastening head 4 mounted thereon and the head includes a vertically movable punch 2 and a vertically movable pocket 3 which houses the punch 2 therein for vertical movement. A horizontally extending lower frame 5 is formed at the outer end portion (the right-hand end portion as seen in FIG. 1) as having a U-shape when viewed horizontally and a slider holding jig 6 is uprightly secured between and to the opposite legs of the U-shape at the outer end of the lower frame 5 which position is offset from right below the head. A holder 9 including a die 8 at the upper end is pivoted to a stub shaft 7, which is provided between and to the opposite legs of the U-shape of the lower frame 5 right below the head 4, for pivotal movement between the retracted position in which the die 8 of the holder 9 is positioned in a position right below the bottom stop fastening head 4 and the advanced position in which the die 8 of the holder 9 is positioned offset from the head 4. In the illustrated embodiment in FIG. 1, although the holder 9 is pivoted to the lower frame 5, the holder may be slid linearly along the opposite legs of the U-shaped outer end of the lower frame 5 as will be described hereinafter.

Figure 2:
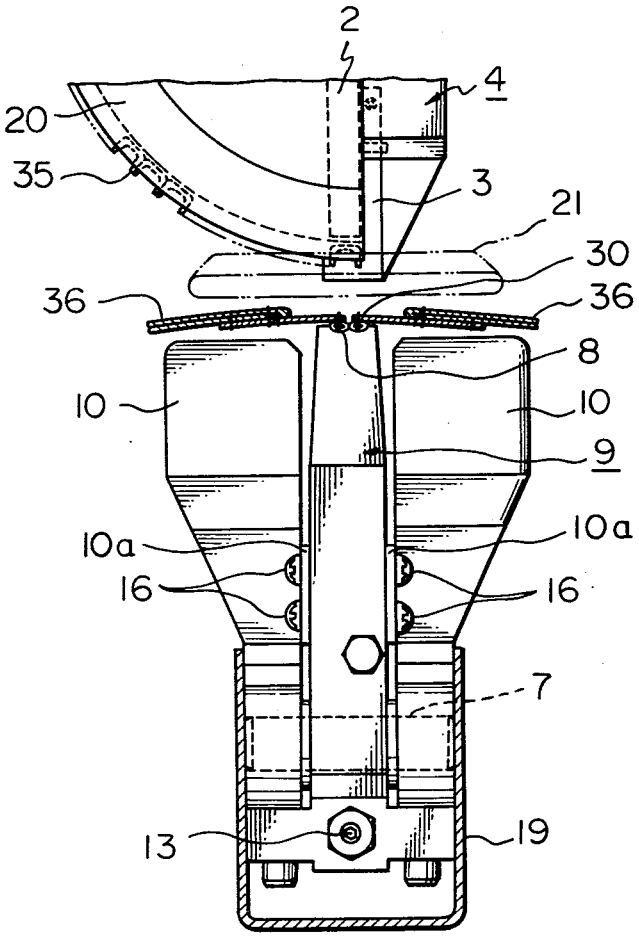
FIG. 2 is a fragmentary front elevational view of said machine as shown in FIG. 1 showing the relationship between the holder and the bottom stop fastening head.

Furthermore, as more clearly shown in FIGS. 1 and 2, a pair of pusher plates 10, 10 are secured to the opposite sides of the holder 9 and project like a wing whereby when the pusher plates 10, 10 are manually pushed in the forward direction or away from the jig 6, the holder 9 is advanced so as to position the die 8 in a position right below the punch 2. In order to retract the holder 9, a pusher pin 12 is received in a cylinder formed at the upper end portion of the lower frame 5 and biased under the force of a spring 11 which is also received in the cylinder in contact with the inner end of the pusher pin 12 so that the pusher pin normally abuts against the holder 9 to urge the holder 9 towards the jig 6. In order to limit the rocking movement of the holder 9 between the advanced and retracted positions, advance and retract stops 13, 14 which are finely adjustable are provided on the lower frame 5.

Although only one pusher plate 10 may be provided projecting from either side of the holder 9, it is preferable to provide the pair of pusher plates 10, 10. And according to the present invention, the position of the pusher plates 10, 10 is adjustable with respect to the holder 9. For this purpose, the holder 9 is provided in the mounting plates 10*a*, 10*a* on the opposite sides thereof with a pair of upper and lower parallel and spaced slots 15, 15 and bolts 16, 16 adjustably hold the pusher plates 10, 10 in position.

When the die 8 is aligned with the punch 2, an instruction is given to the machine for performing the bottom stop fastening operation. Although such an instruction can be given by a foot switch, for example, in the illustrated embodiment, the means in the form of a limit switch 17 is mounted on the lower frame 5 and actuated by a dog 18 mounted on the holder 9. Fitted on the lower frame 5 is a shield cover 19 which covers the lower portion of the lower frame.

The bottom stop fastening head 4 includes the pocket 3 for receiving a bottom stop 35 therein which is successively fed by a through structure 20 and the punch 2 which is movable up and down within the pocket 3. At first, both the pocket 3 and the punch 2 are moved downwardly until the bottom of the pocket 3 abuts against the slide fastener chain 30 on the die 8, whereupon the pocket ceases its downward movement and is caused to open laterally to release the bottom stop while the punch 4 continues to move downwardly to strike against one of the bottom stop 35 whereby the bottom stop is secured in the fastener chain. In FIG. 1, reference numeral 21 denotes a safety cover secured to the upper frame 1.

The slider holding jig 6 is formed at the upper end with a concaved recess 22 for receiving a slider 31 in a stabilized position with the pull tab attachment side of the slider being disposed on the top. The slider holding jig 6 is further formed with a vertical pull tab insertion groove 23 in communication with and extending downwardly from the recess 22 for receiving the pull tab 33 of the slider 31. The slider holding jig 6 is further formed with a horizontal slot 23*a* which communicates with the vertical groove 23 in an intermediate point between the upper and lower ends of the latter. A ball 24 is received in the slot 23*a* to be forced into the window 34 in the pull tab 33 under the force provided by a spring (not shown) or an air cylinder 25 through a lever 26. In order that the force applied to the ball 24 to force the ball into the pull tab window 34 is generated only when the pull tab 33 is inserted into the pull tab insertion groove 23, a sensor rod 27 extends upwardly through a vertical opening 23*b* in the jig 6 and is biased upwardly toward the groove 23 under the force of a spring 28. A selector valve 29 is mounted in the jig 6 below the lower end of the sensor rod 27 to control the operation of the air cylinder 25. Thus, when the sensor rod 27 is moved downwardly by pulling the pull tab 33, air under pressure is supplied through the selector valve 29 into the air cylinder 25 which in turn applies a force to the ball 24. However, the slider holding jig 6 is not limited to the illustrated construction, but may have any other suitable construction.

Figure 5:
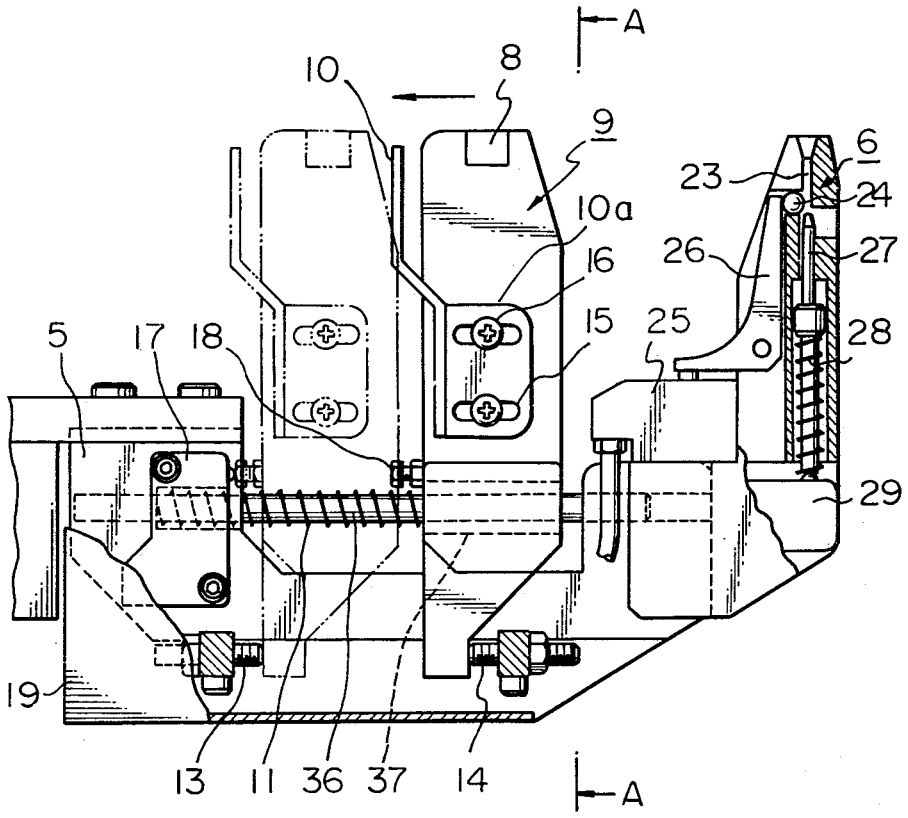
FIG. 5 is a fragmentary side elevational view of another embodiment of the slide fastener finishing machine of the present invention.
Figure 6:
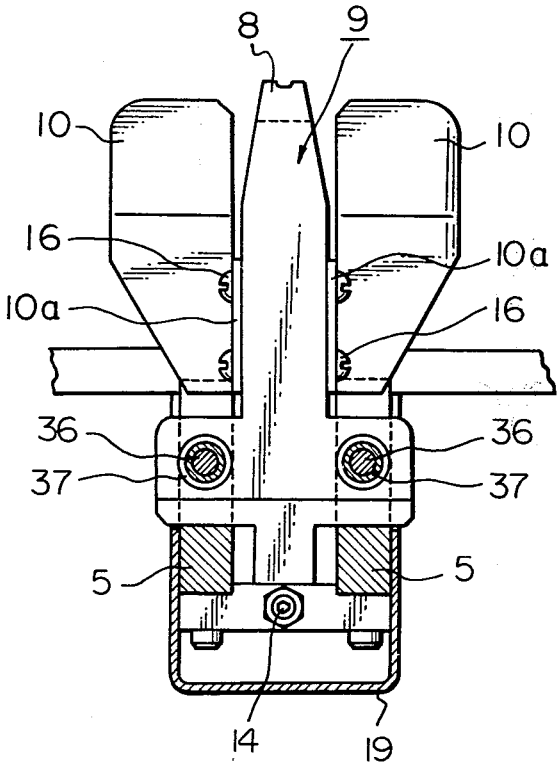
FIG. 6 is a cross-sectional view taken substantially along the line A—A and as seen in the arrow direction in FIG. 5.

Next, a modified embodiment of the invention having a means adapted to move the die holder 9 slidably will be now described referring to FIGS. 5 and 6. Namely, a pair of guide rods 36, 36 are provided in the bifurcated end of the lower frame 5 extending in parallel to each other and the holder 9 having the die 8 is mounted on the guide rods 36 with slide bearings 37, 37 interposed therebetween for slidable movement along the rods. As in the first embodiment, the reciprocal movement of the die holder 9 is limited by the advance stopper 13 and retraction stopper 14 like in the first embodiment. Furthermore, the slider holding jig 6 is pivotally mounted at the extreme outer end of the lower frame 5 and the holder 9 is normally urged outwardly by means of the springs 11, 11 as in the first embodiment.

Figure 3:
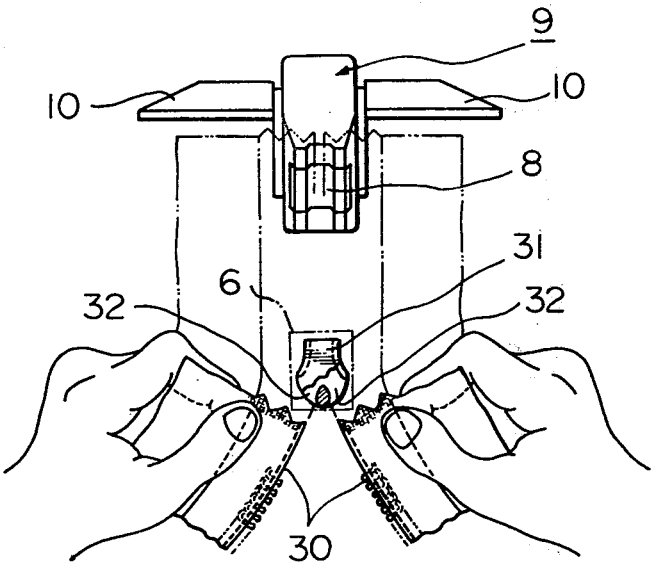
FIG. 3 is a plan view showing the manner in which the fastener chains are threaded through the slider in the machine of the invention.
Figure 4:
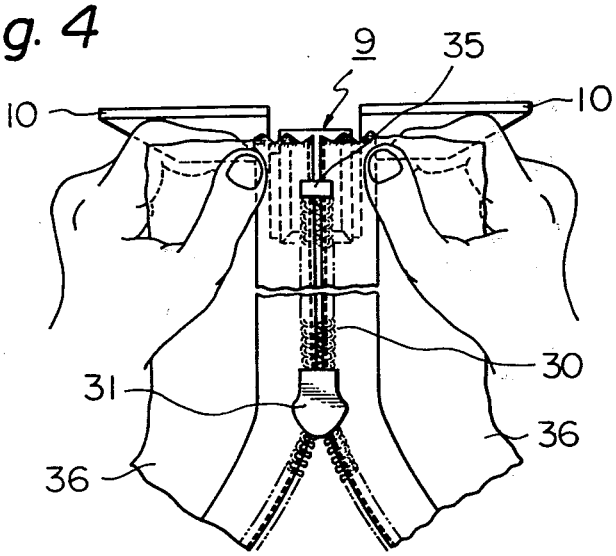
FIG. 4 is a plan view showing the manner in which a bottom stop is fastened to the fastener chains.

With the above-mentioned construction and arrangement of the slide fastener finishing machine of the present invention, when the slide fastener finishing machine of the invention is operated for performing the finishing work on the fastener chains 30 (which are attached to a clothing 36 such as the trousers' fly in the illustrated embodiment), first of all, the slider 31 is held in the concaved recess 22 at the upper end of the jig 6 in such a manner that the throats 32, 32 of the slider 31 direct to the operator i.e., opposite from the bottom stop fastening head 4 as seen in FIG. 3. The operator then grips the fastener chains 30 at its leading end by the finger tips of both hands and pulls the chains apart from each other as shown in FIG. 3. Thereafter, the fastener chains 30 are threaded through the slider 31 maintaining their parallel relationship. As the fastener chains 30 are threaded through the slider 31, the chains 30 mesh with each other. The chains are advanced until the leading end portions of the fastener chains 30 are positioned just below the bottom stop fastening head 4. As the fastener chains 30 are advanced in this manner, the fastener chains 30 pass over the die 8 on the holder 9 and the operator's fingers engage the pusher plates 10. As the fastener chains 30 are further advanced, the operator's fingers push the pusher plates 10 forwardly or leftwards as seen in FIG. 1 until the holder 9 is positioned just below the bottom stop fastening head 4. When the particular portion of the fastener chains 30 to which the bottom stop 35 to be fastened is positioned just below the punch 2, this is sensed by the limit switch 17 and the punch 2 and the pocket 3 are lowered. By this, bottom stop 35 is fastened to the fastener chains 30 to thereby complete the slide fastener finishing operation. At the end of the finishing operation on the slide fastener, when the fastener chains 30 are taken out of the machine, the slider 31 is also removed from the jig 6. At this time, since the holder 9 is biased rightwards by the spring 11, when the finger force applied by the operator is removed from the holder, the holder 9 automatically assumes the initial position as shown by the solid line in FIG. 1 whereby the machine is ready for the next finishing operation. The operation of the modified embodiment in which the holder 9 is adapted to slide linearly is similar to that of the first embodiment.

As is clear from the foregoing description, according to the present invention, since the slider holding jig is positioned remote from the punch closer to the operator, the die holder is positioned between the position just below the punch and the slider toward the position just below the punch holding jig and is movable and the pusher plates are secured to and project from the die holder, while the fastener chains are manually fed to the position just below the punch where the fastener chains are threaded through the slider to mesh with each other and the chains are further moved toward the position just below the punch together with the die while maintaining the particular portion of the fastener chains to which the bottom stop is to be fastened in position on the die. Thus, since the fastener chains are fed only in one direction and the die is also moved to the position just below the punch together with the chains, it is not necessary to change the manner of gripping the chains while they are fed and the fastener chains are finished by only a simple feeding operation. By this, operation efficiency of fastener chain finishing is greatly improved and the bottom stop is fastened to the predetermined position safely and positively.

What is claimed is:

1. A slide fastener finishing machine for applying a bottom stop to a slide fastener chain comprising an upper frame, a bottom stop fastening head mounted on said upper frame for vertical movement and having a punch, a lower frame, a slider holding jig fixedly secured to said lower frame and offset from the position right below said punch for an operator to thread said slide fastener chain, with his fingertips grasping said slide fastener chain, through said slider holding jig, a die holder mounted on said lower frame between said position right below the punch and said slider holding jig, said die holder having a die on the top thereof and being movable to a first position in which said die is aligned with said punch from a second position, to which said die holder is normally biased by biasing means, in which the die is offset from the punch, pusher plate means secured to and extending from said die holder to be pushed by the back of the hands of the operator as one end of said slide fastener chain threaded through said slider holding jig overlies said die holder to position said die holder directly beneath said punch such that the fingertips of said operator continuously grip the slide fastener chain during threading through said slider holding jig and application of said bottom stop.

2. The slide fastener finishing machine as set forth in claim 1 in which said die holder is pivoted at the lower end to said lower frame.

3. The slide fastener as set forth in claim 1 or 2 in which the movement of said die holder is limited by advance and retraction stoppers mounted on said lower frame in spaced relationship.

4. The slide fastener finishing machine as set forth in claim 1 or 2 in which said die holder is normally biased to said second position by spring-loaded biasing means mounted on said lower frame.

5. The slide fastener finishing machine as set forth in claim 1 or 2 in which said pusher plates are adjustably secured to said die holder so that the mounting position of the pusher plates is adjustable in the direction of movement of the die holder.

* * * * *